US006018946A

United States Patent [19]

Matsumoto

[11] Patent Number: 6,018,946

[45] Date of Patent: Feb. 1, 2000

[54] EXHAUST MANIFOLD OF MULTI-CYLINDER INTERNAL COMBUSTION ENGINE

[75] Inventor: Seiji Matsumoto, Wako, Japan

[73] Assignee: Honda Giken Kogyo Kabushiki Kaisha, Tokyo, Japan

[21] Appl. No.: 08/925,733

[22] Filed: Sep. 9, 1997

[30] Foreign Application Priority Data

Sep. 12, 1996 [JP] Japan ..... 8-241831

[51] Int. Cl.[7] ..... F01N 7/10

[52] U.S. Cl. ..... 60/323; 29/890.08

[58] Field of Search ..... 60/323, 313; 29/890.08

[56] References Cited

U.S. PATENT DOCUMENTS

| | | | |
|---|---|---|---|
| 4,537,027 | 8/1985 | Harwood et al. | 60/323 |
| 4,689,952 | 9/1987 | Arthur et al. | 60/313 |
| 4,850,189 | 7/1989 | Arthur et al. | 60/323 |
| 5,682,741 | 11/1997 | Augustin et al. | 60/323 |
| 5,743,011 | 4/1998 | Dickerson et al. | 29/890.08 |

FOREIGN PATENT DOCUMENTS 63-26252 5/1988 Japan .

*Primary Examiner*—Thomas E. Denion

*Attorney, Agent, or Firm*—Armstrong, Westerman, Hattori, McLeland & Naughton

[57] ABSTRACT

An exhaust manifold made of plate metal in which sufficient strength and rigidity can be ensured, lightening of the weight is intended by making walls thin as a whole, and early activation of a catalyst is easy. The exhaust manifold is one for a multi-cylinder internal combustion engine having two groups of cylinders selected so that exhaust strokes are not successive. The exhaust manifold includes two exhaust pipe sections containing exhaust pipes communicating with the cylinders of one of the groups respectively, confluence sections where the exhaust pipes in each of the exhaust pipe sections join respectively, and a gathering section where the confluence sections join. Further, the exhaust manifold is constructed by an obverse half body, a partition body and a reverse half body made of plate metals and laid face to face with each other, the exhaust pipe sections and the confluence sections are formed by the partition body and one of the obverse and reverse half bodies, and the gathering section is formed by the obverse half body and the reverse half body.

4 Claims, 9 Drawing Sheets

EXHAUST MANIFOLD OF MULTI-CYLINDER INTERNAL COMBUSTION ENGINE

BACKGROUND OF THE INVENTION

This invention relates to an exhaust manifold of a multi-cylinder internal combustion engine.

In a multi-cylinder internal combustion engine, a construction that a plurality of cylinders are grouped in two groups in which exhaust strokes of cylinders are not successive and exhaust pipes communicating with the cylinders gather according to the respective groups is adopted in order to avoid an exhaust interference.

An exhaust manifold of such construction is made of cast iron generally, but in order to reduce the weight, there has been proposed an exhaust manifold constructed by plate metal members laid face to face with each other.

As an example thereof, an exhaust manifold described in Japanese Patent Publication No. Sho 63-26252 is shown in FIG. 12, which is an exploded view of the exhaust manifold 01. It is constituted by assembling three plate metal members, that is an upper side half body 02, a partition body 03 and a lower side half body 04, face to face with each other.

The upper side half body 02 is formed with four half walls 02*a*, 02*b*, 02*c*, 02*d* which swell out upward in shape of about semicircular cylinders parallel with each other and a confluence half wall 02*e* where inner two half walls 02*b*, 02*c* join to each other. The outer two half walls 02*a*, 02*d* merely project from the inner half walls 02*b* 02*c* outward and interiors of the outer half walls 02*a*, 02*d* do not communicate with the interior of the confluence half wall 02*e*.

On the one hand, the lower side half body 04 is formed with four half walls 04*a*, 04*b*, 04*c*, 04*d* which swell out downward in shape of about semicircular cylinders parallel with each other and a confluence half wall 04*e* where the outer half walls 04*a*, 04*d* join to each other. The inner two half walls 04*b*, 04*c* are merely positioned between the outer two half walls 04*a*, 04*d* and interiors of the inner half walls 04*b*, 04*c* do not communicate with the interior of the confluence half wall 04*e*.

The partition body 03 is formed with four half walls 03*a*, 03*b*, 03*c*, 03*d* which are semicircular cylindrical and parallel with each other and a confluence partition plate 03*e* of a flat plate shape. The inner two half walls 03*b*, 03*c* swell out downward, and the outer two half walls 03*a*, 03*d* swell out upward.

When the upper side half body 02, the partition body 03 and the lower side half body 04 are put together face to face, the inner half walls 02*b*, 02*c* of the upper half body 02 and the inner half walls 03*b*, 03*c* of the partition body 03 join together to form two inner exhaust pipes, the confluence half wall 02*e* and the confluence partition wall 03*e* form an inner side confluence section where the inner exhaust pipes join, the outer two half walls 04*a*, 04*d* of the lower side half body 04 and the outer two half walls 03*a*, 03*d* of the partition body 03 join together to form two outer exhaust pipes, and the confluence half wall 04*e* and the confluence partition plate 03*e* form an outer side confluence section where the outer exhaust pipes join.

The above-mentioned exhaust manifold 01 is relatively light in weight because it is constructed by plate metal members laid face to face with each other, but the individual exhaust pipe has a doubled half wall portion on a single wall formed by the half walls joined together.

Since sufficient strength and rigidity are ensured by the single wall, the doubled half wall portion is unnecessarily thick only to increase the weight uselessly. An exhaust manifold having appropriate wall thickness as a whole can not be formed, therefore, temperature of the exhaust immediately after starting is hardly transmitted to an exhaust cleaning catalyst apparatus (catalyst converter) so that activation of the catalyst is delayed and the exhaust cleaning at an early stage is difficult.

The present invention has been accomplished in view of the foregoing and an object of the invention is to provide an exhaust manifold made of plate metal in which sufficient strength and rigidity can be ensured, lightening of the weight is intended by making walls thin as a whole, and early activation of the catalyst is easy.

SUMMARY OF THE INVENTION

In order to attain the above object, the present invention provides an exhaust manifold of a multi-cylinder internal combustion engine having two groups of cylinders selected so that exhaust strokes are not successive, including two exhaust pipe sections containing exhaust pipes communicating with the cylinders of one of the groups respectively, confluence sections where the exhaust pipes in each of the exhaust pipe sections join respectively, and a gathering section where the confluence sections join, wherein the exhaust manifold is constructed by an obverse half body, a partition body and a reverse half body made of plate metals and laid face to face with each other; the exhaust pipe sections and the confluence sections are formed by the partition body and one of the obverse and reverse bodies; and the gathering section is formed by the obverse half body and the reverse half body.

Since the exhaust manifold is constituted by three plate metal members and the exhaust pipe sections and the confluence sections are formed by the partition body and one of the obverse and reverse bodies so as to be walled by a single layer of plate metal, entire wall thickness can be made thin to lighten the weight as well as sufficient strength and rigidity can be ensured and early activation of the catalyst is facilitated.

Further, the present invention provides an exhaust manifold of a multi-cylinder internal combustion engine having two groups of inner cylinders and outer cylinders selected so that exhaust strokes are not successive, including an inner side exhaust pipe section containing exhaust pipes communicating with the inner cylinders respectively, an outer side exhaust pipe section containing exhaust pipes communicating with the outer cylinders respectively, an inner side confluence section where the exhaust pipes in the inner side exhaust pipe section join, an outer side confluence section where the exhaust pipes in the outer side exhaust pipe section join, and a gathering section where the inner side confluence section and the outer side confluence section join, wherein the exhaust manifold is constructed by an obverse half body, a partition body and a reverse half body made of plate metals and laid face to face with each other; the inner side exhaust pipe section and the inner side confluence section are formed by the obverse half body and the partition body; the outer side exhaust pipe section and the outer side confluence section are formed by the reverse half body and the partition body; and the gathering section is formed by the obverse half body and the reverse half body.

According to the above exhaust manifold, layout of good space efficiency, lightening of the exhaust manifold and early activation of the catalyst are possible, while avoiding exhaust interference.

By making the partition body thicker than any of the obverse half body and the reverse half body, it is possible to make average wall thickness of the whole exhaust manifold thin for lightening while strength and rigidity necessary for the exhaust manifold are maintained.

A silencer may be arranged on reverse side surfaces of the partition body and the reverse half body and a communication hole communicating with the silencer may be formed in the partition body at the confluence section on the side of the obverse half body. In the exhaust manifold having such a silencer, combination rigidity of the confluence section which becomes at the highest temperature can be ensured.

Since the partition body is made thicker than the obverse and reverse half bodies, the silencer can be disposed on the partition body, strength of the whole exhaust manifold can be maintained easily and a length of the communication hole necessary for obtaining resonance effect can be ensured easily because the communication hole is formed in the partition body.

DETAILED DESCRIPTION OF THE PREFERRED EMBODIMENT

Referring now to FIGS. 1 to 11, one preferred embodiment of the present invention will be described.

Figure 1:
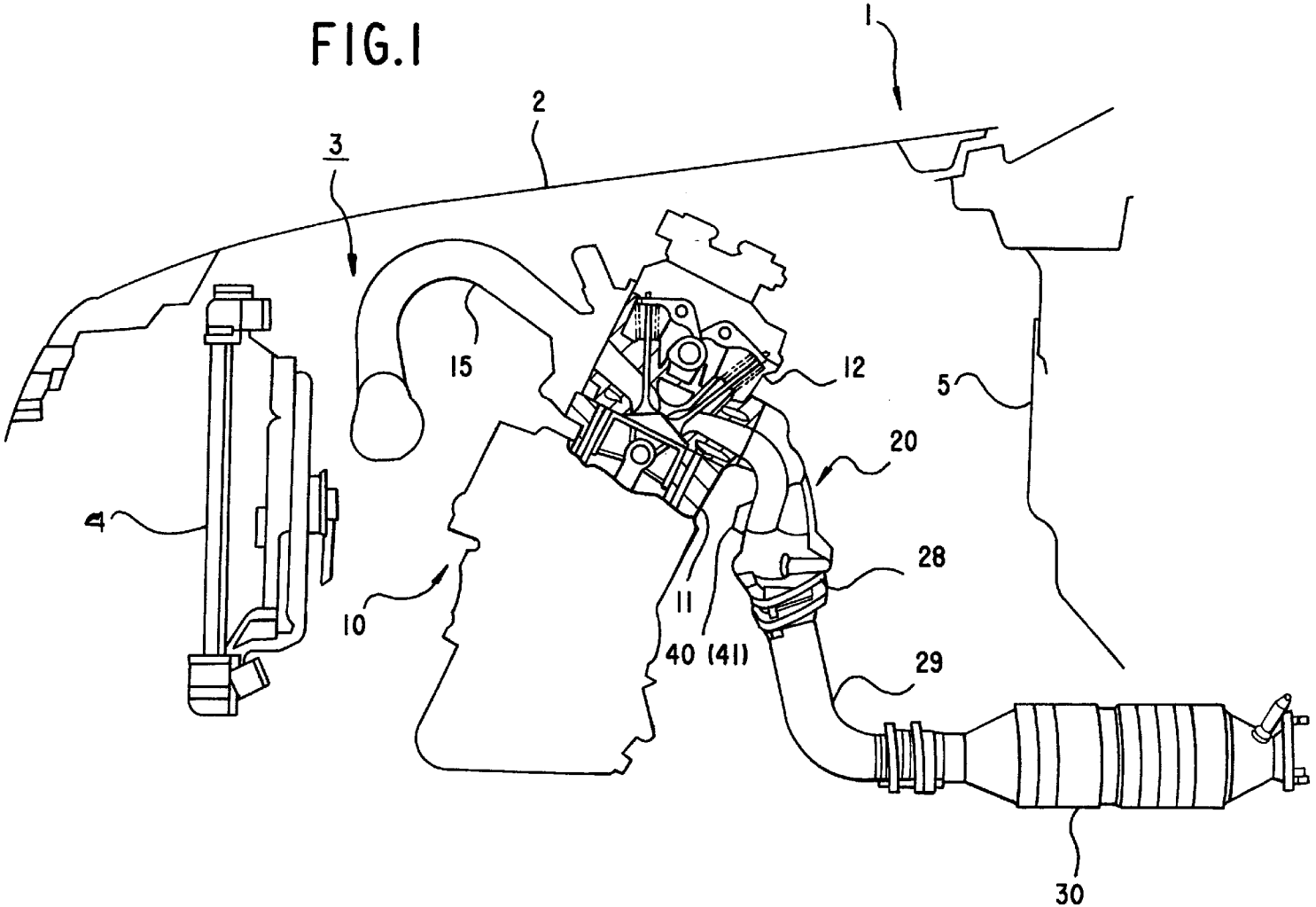
FIG. 1 is a rough side view showing an internal combustion engine with an exhaust manifold according to the present invention arranged within a front body of a motorcar.
Figure 2:
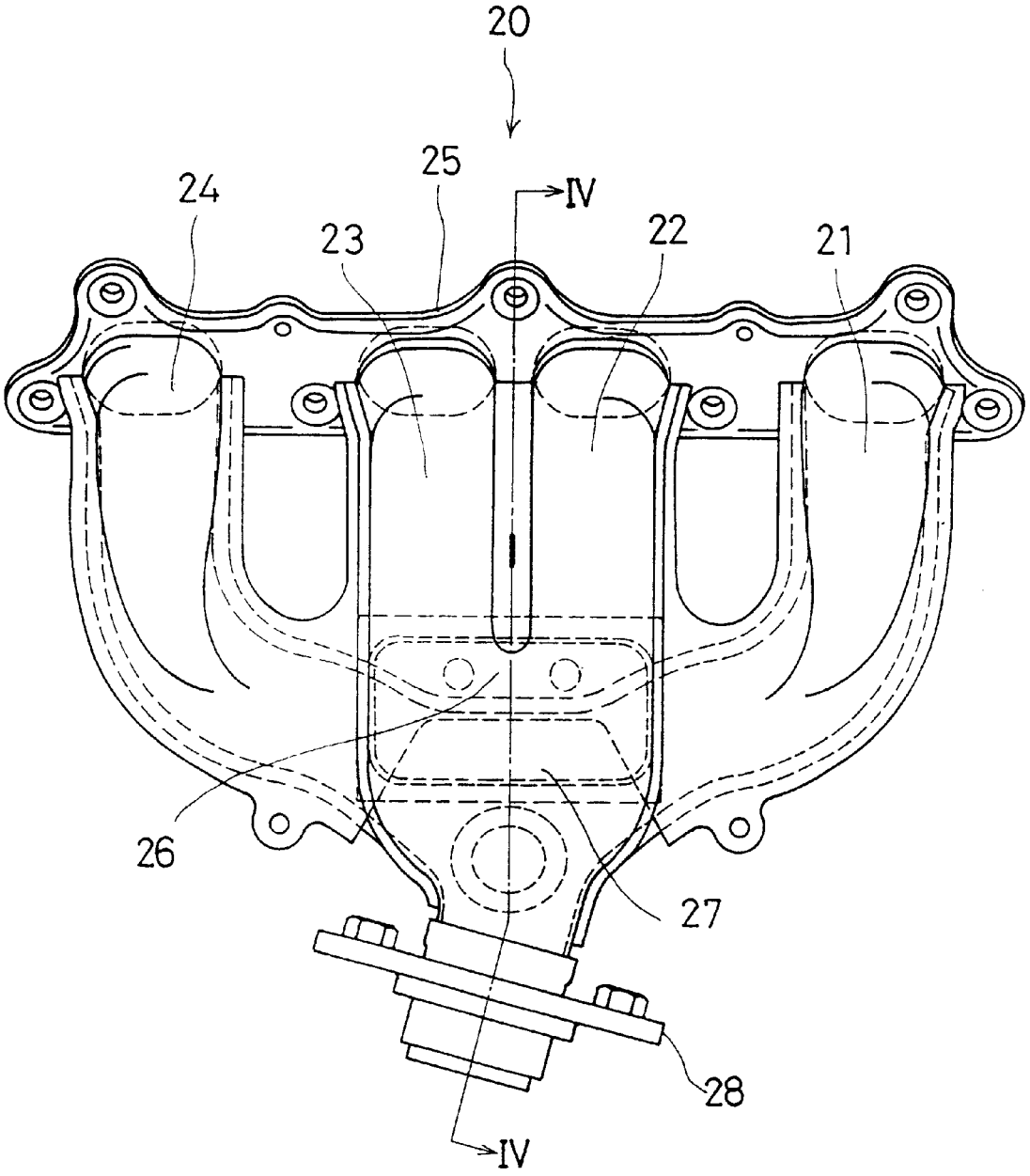
FIG. 2 is a rear view of the exhaust manifold.
Figure 3:
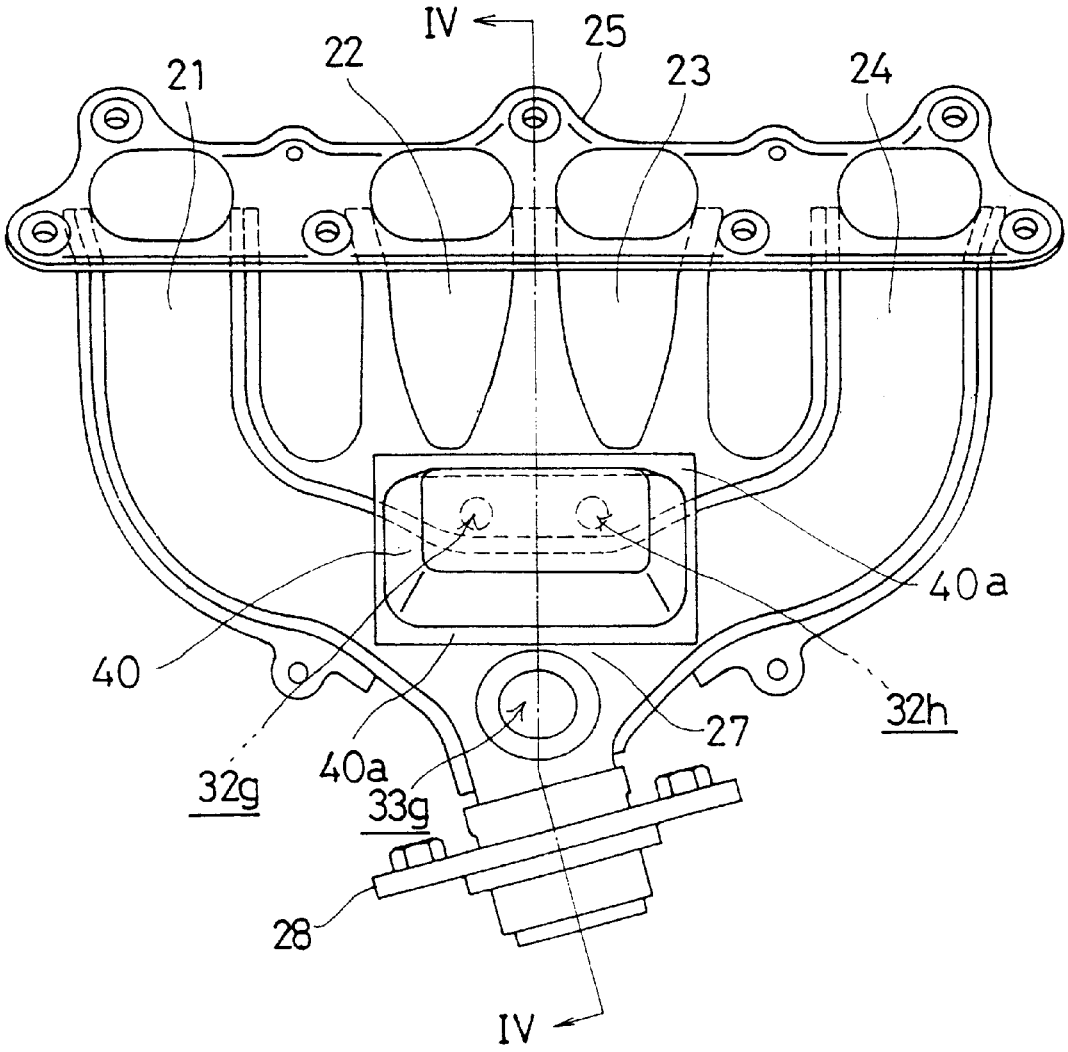
FIG. 3 is a front view thereof.

A motorcar 1 in the embodiment is a FF (front engine—front drive) car and FIG. 1 is a rough side view showing an internal combustion engine 10 arranged in a front part of the motorcar 1.

Within an engine compartment 3 under a bonnet 2 and between a radiator 4 in front and a dashboard 5 in rear is mounted a straight type 4 cylinders internal combustion engine 10 with a crankshaft directed laterally and cylinder block 11 inclined rearward.

From a cylinder head 12 on the cylinder block 11, a suction manifold 15 extends forward and an exhaust manifold 20 extends rearward.

Provided four cylinders of the internal combustion engine 10 arranged in line laterally with respect to the car body are named respectively first, second, third and fourth cylinder in turn from the right side (right side when viewed facing in travelling direction of the car), the first and fourth cylinders constitute a cylinder group that exhaust strokes are not successive and similarly the second and third cylinders constitute another cylinder group that exhaust strokes are not successive.

First, second, third and fourth exhaust pipes 21, 22, 23 and 24 communicating with the first, second, third and fourth cylinders, respectively, extend rearward from the cylinder head of the internal combustion engine 10.

Respective base ends of the first, second, third, fourth exhaust pipes 21, 22, 23, 24 are fitted to a common oblong head flange 25 to be supported and connected with the cylinder head 12.

The first, second, third, fourth exhaust pipes 21, 22, 23, 24 extend rearward from the head flange 25 and bend downward, then the second and third exhaust pipes 22, 23 positioned inside join with each other at a central confluence section 26 and the first and fourth exhaust pipes 21, 24 positioned outside join with each other at another central confluence section 26.

Further, the above-mentioned two confluence sections 36 join with each other at a gathering section 27 in a lower stream end of the exhaust manifold 20. The gathering section 27 is connected to a gathering exhaust pipe 29 by a connecting flange 28. At a lower stream part of the gathering exhaust pipe 29 is connected a catalyst converter 30.

Figure 5:
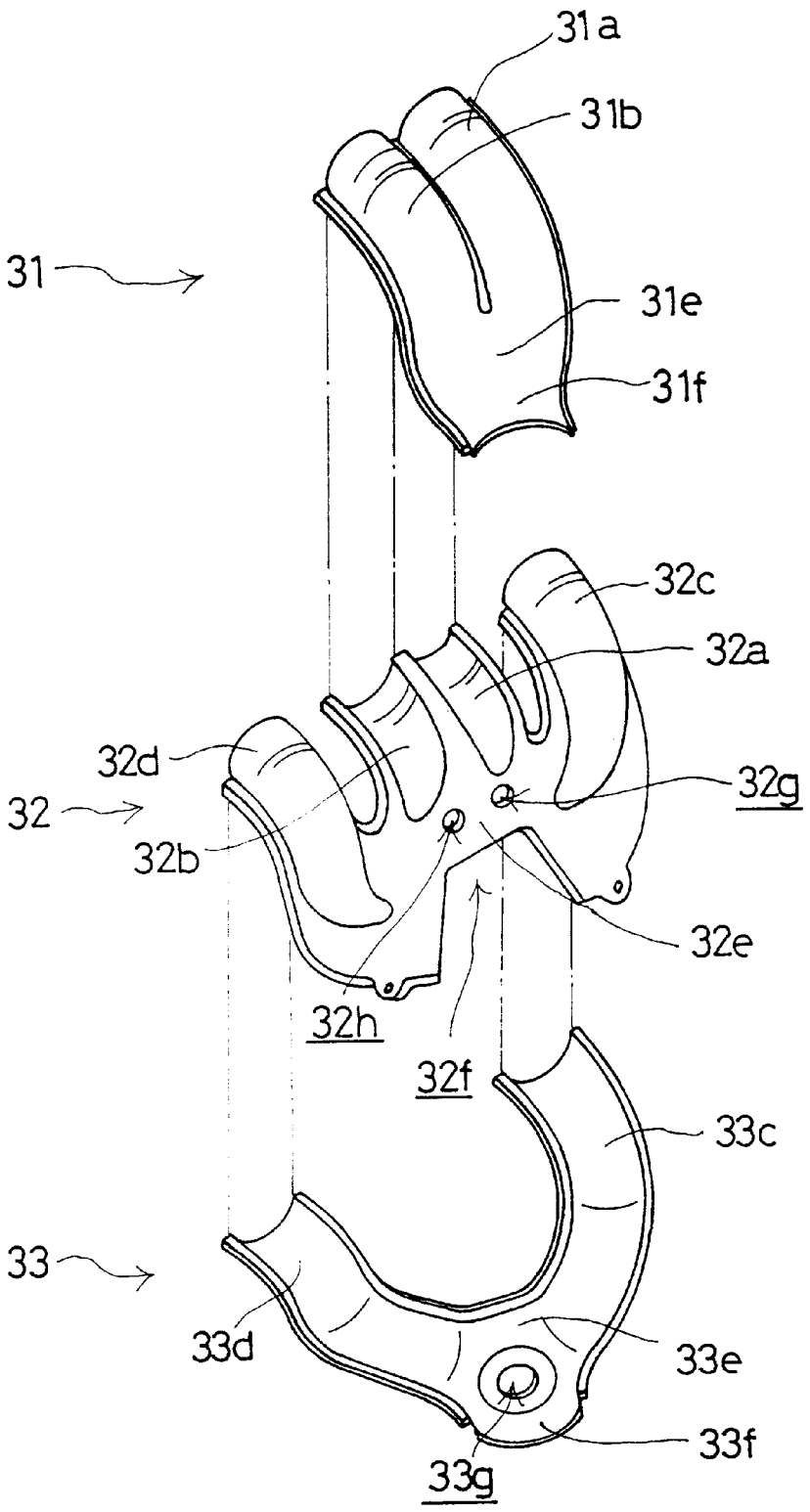
FIG. 5 is an exploded perspective view of the exhaust manifold.

As shown in FIG. 5, the exhaust manifold 20 is formed by an obverse half body 31, a partition body 32 and a reverse half body 33 made of plate metal members and laid face to face with each other.

Figure 6:
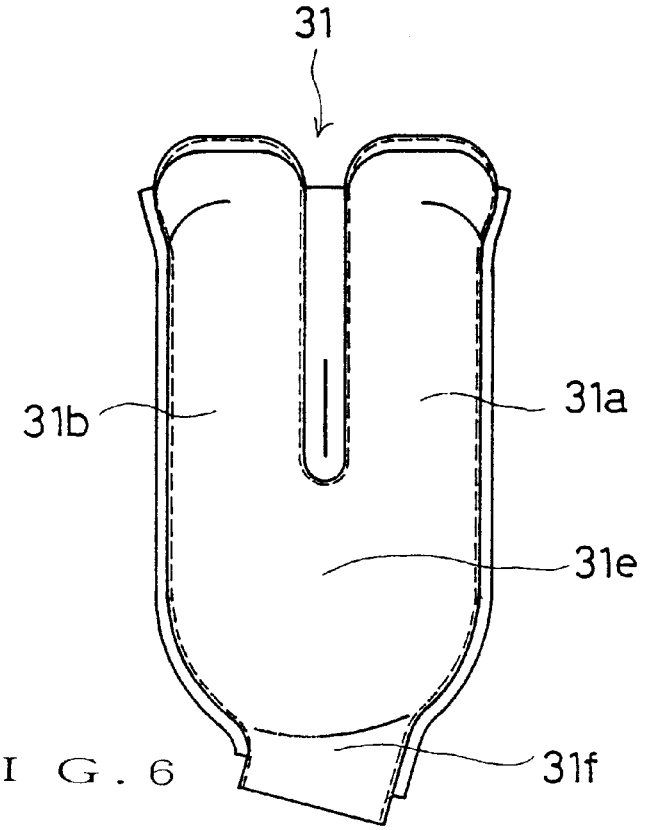
FIG. 6 is a rear view of an obverse half body.
Figure 7:
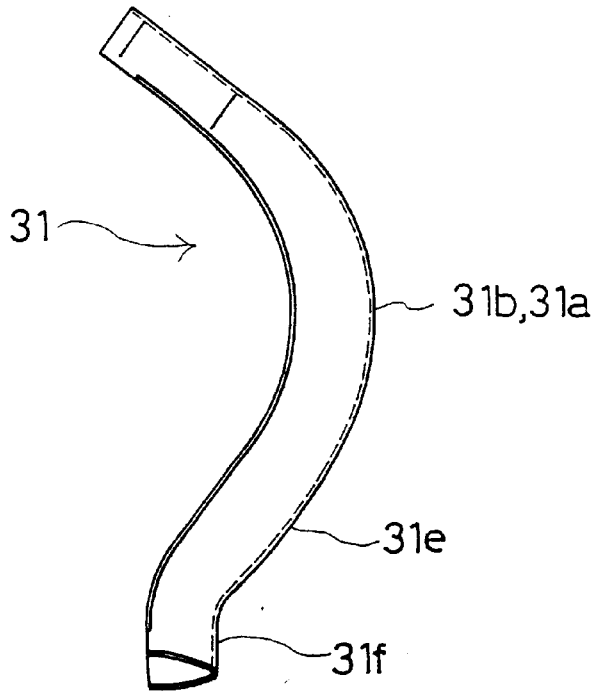
FIG. 7 is a side view thereof.

Referring to FIGS. 6, 7, the obverse half body 31 constitutes obverse side (upper side) second and third half walls 31*a*, 31*b* of the second and third inner exhaust pipes 22, 23, a obverse side confluence half wall 31*e* of the confluence section 26 and a obverse side gathering half wall 31 of the gathering section 27. The obverse side second and third half walls 31*a*, 31*b* are adjacent to and parallel with each other and bent similarly.

Figure 8:
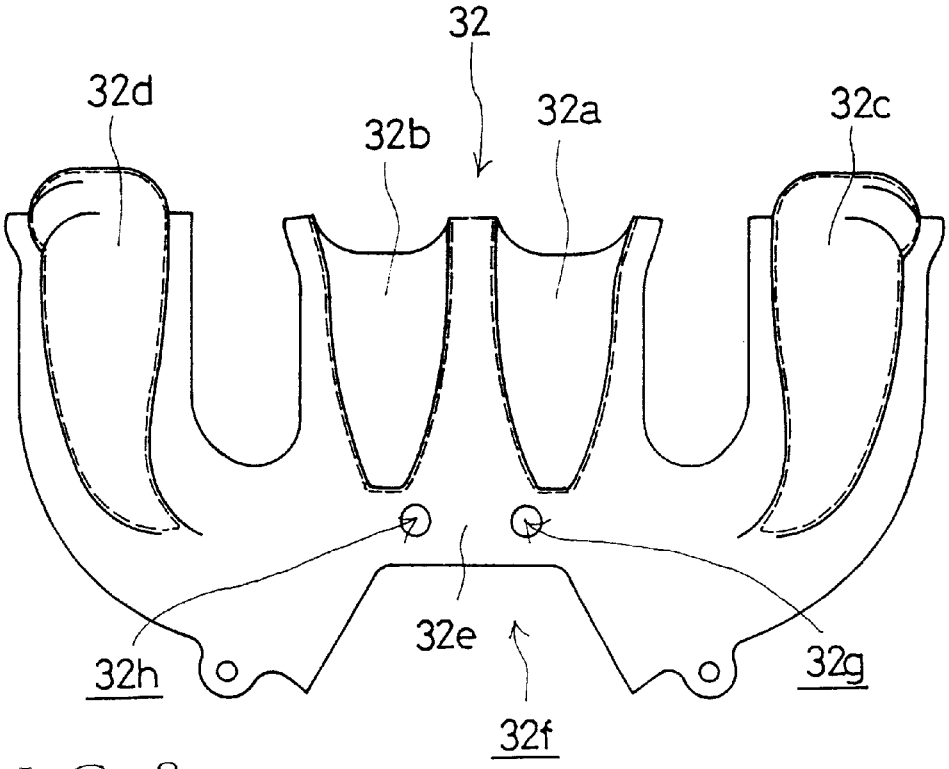
FIG. 8 is a rear view of a partition body.
Figure 9:
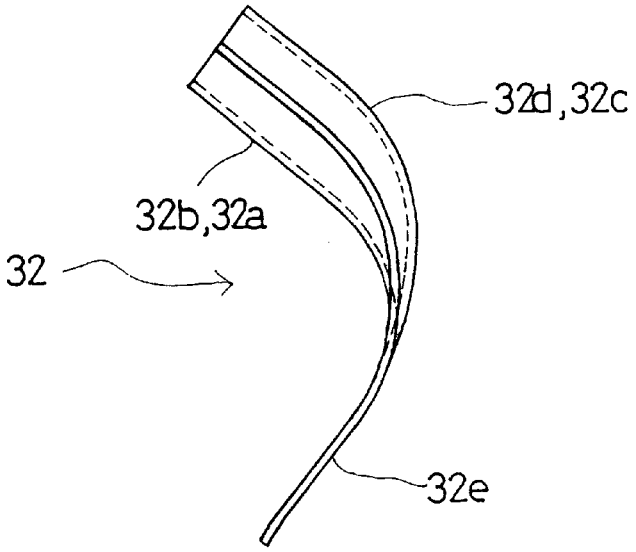
FIG. 9 is a side view thereof.

Referring to FIGS. 8, 9, the partition body 32 is formed with reverse side (under side) second and third half walls 32*a*, 32*b* of the second and third inner exhaust pipes 22, 23, obverse side first and fourth half walls 32*c*, 32*d* of the first and fourth outer exhaust pipes 21, 24 separated outward from the reverse side second and third half walls 32*a*, 32*b*, and a confluence partition section 32*e* extending from the half walls 32*a*, 32*b*, 32*c*, 32*d* as if it gathers the half walls in one. The confluence partition section 32*e* corresponds to the confluence section 26. The partition body 32 is bent as a whole (FIG. 9).

A cut 32*f* is formed at a portion on the lower stream side of the confluence partition section 32*e* corresponding to the gathering section 27 and two communication holes 32*g*, 32*h* are formed in the confluence partition section 32*e* at an upper stream side of the cut 32*f*.

Figure 10:
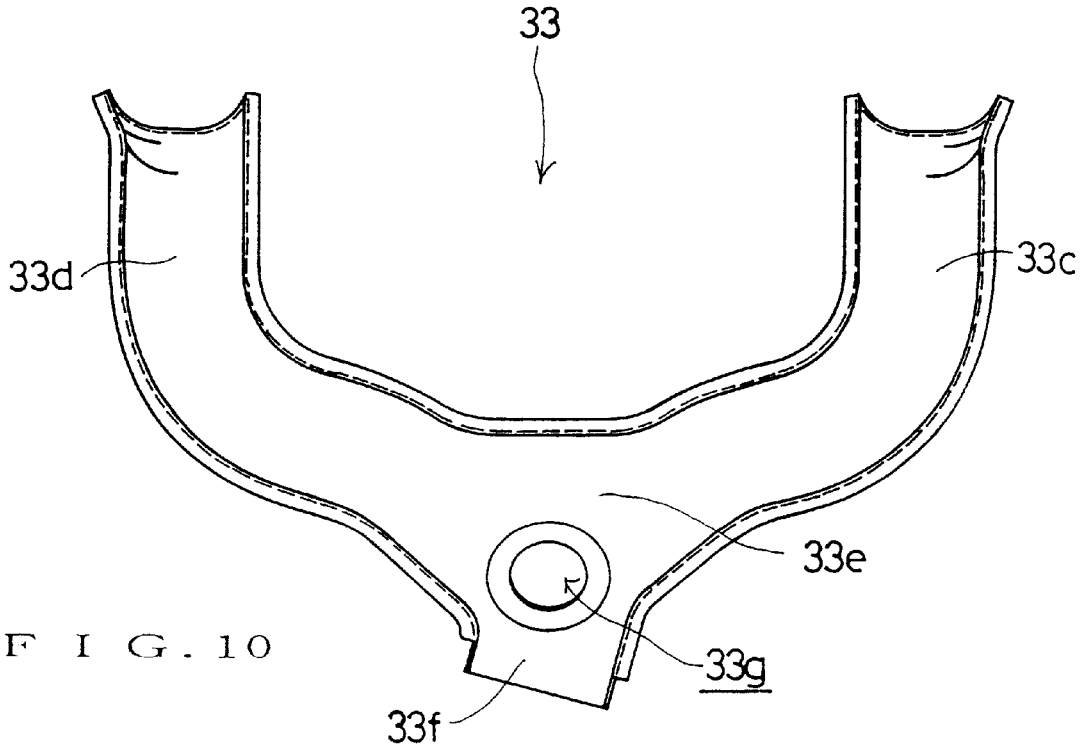
FIG. 10 is a rear view of a reverse half body.
Figure 11:
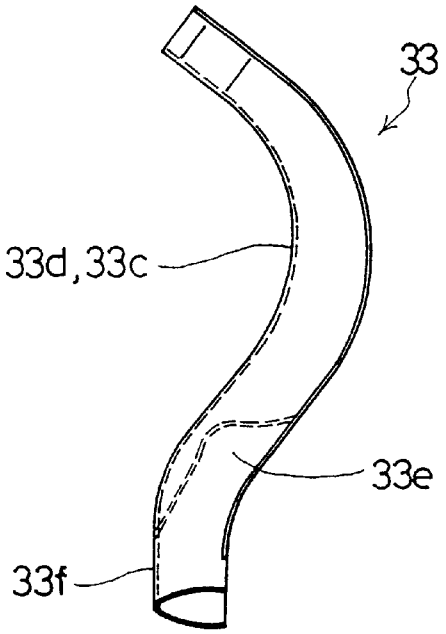
FIG. 11 is a side view thereof.
Figure 12:
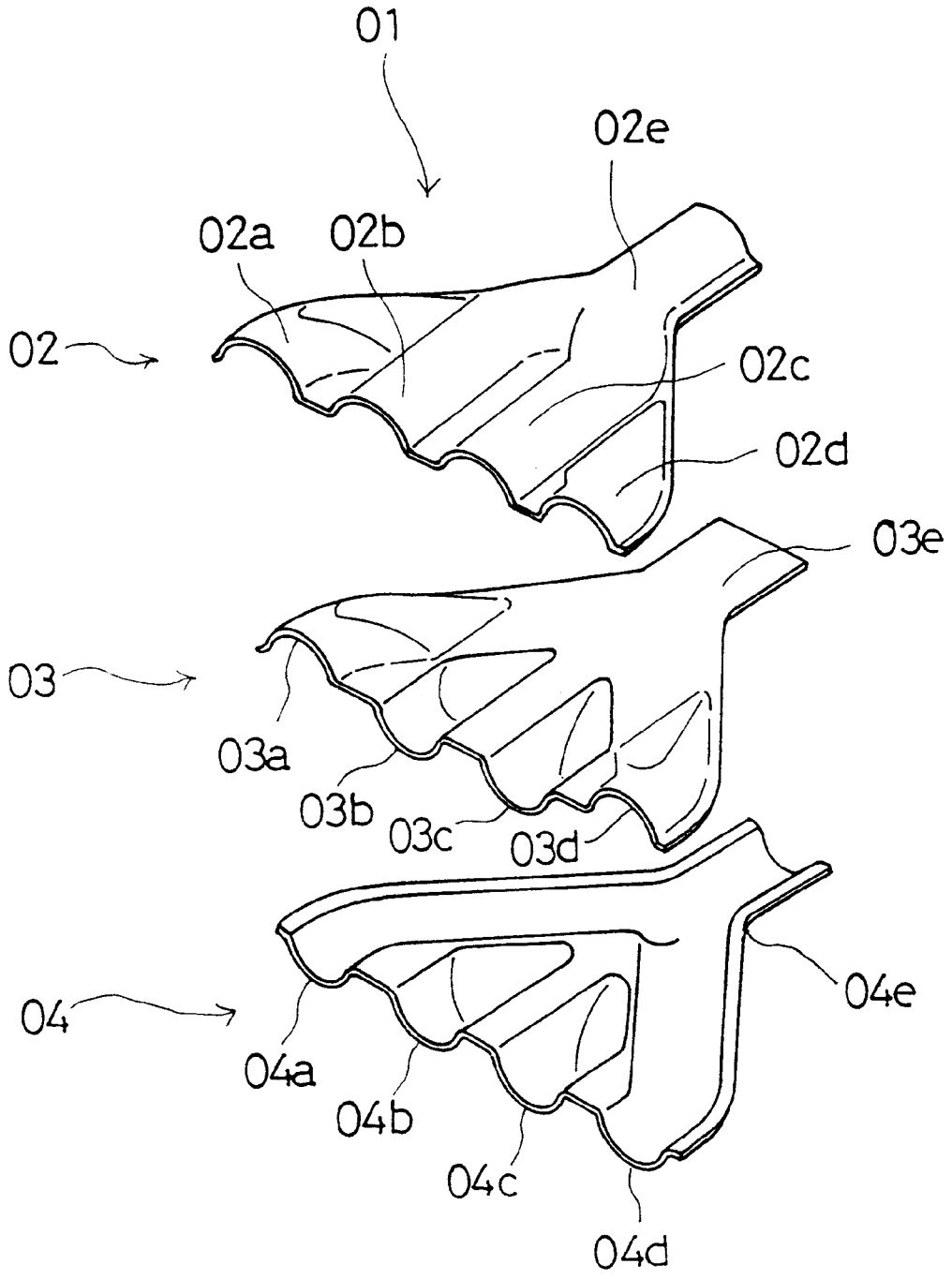
F I G. 12 PRIOR ART
FIG. 12 is an exploded perspective view of a conventional exhaust manifold.

Referring to FIGS. 10, 11, the reverse half body 33 has reverse side first and fourth half walls 33*c*, 33*d* of the first and fourth outer exhaust pipes 21, 24 branched right and left from a reverse side confluence half wall 33*e* of the confluence section 26 and is bent as a whole as shown in FIG. 11. In addition, at a lower stream of the reverse side confluence half wall 33*e* is formed a reverse side gathering half wall 33*f* of the gathering section 27.

An attachment hole 33*g* for an oxygen sensor is formed at a center of the reverse side confluence half wall 33*e*.

Wall thickness of the reverse half body and the obverse half body are the same, but the partition body 32 is made of a more rigid metal plate thicker than the obverse and reverse half bodies 31, 33.

The above-mentioned obverse half body 31, partition body 32 and reverse half body 33 are laid face to face in order as shown in FIG. 5 and welded. At that time, the obverse side second, third half walls 31*a*, 31*b* of the obverse half body 31 and the reverse side second, third half walls 32*a*, 32*b* join together to form the second, third exhaust pipes 22, 23, and the first, fourth half walls 33*c*, 33*d* of the reverse half body 33 and the first, fourth half walls 32*c*, 32*d* of the partition body 32 join together to form the first, fourth exhaust pipes 21, 24.

The obverse side confluence half wall 31*e* of the obverse half body 31 and the reverse side confluence half wall 33*e* of the reverse half body 33 join together holding the confluence partition section 32*e* of the partition body 32 between them, so that an inner side confluence section 26*a* (FIG. 4) where the second and third exhaust pipes 22, 23 join is formed on the obverse side, and an outer side confluence section 26*b* (FIG. 4) where the first and fourth exhaust pipes 21, 24 join is formed on the reverse side. The inner side and outer side confluence sections 26*a*, 26*b* separated by the confluence partition section 32*e* gather to each other at the cut 32*f* on the lower stream side. Therefore, the gathering section 27 is formed by the obverse side gathering half wall 31*f* of the obverse half body 31 and the reverse side gathering half wall 33*f* of the reverse half body 33.

The second and third exhaust pipes 22, 23 communicating with the inner cylinders with exhaust strokes not successive communicate with each other at the inner side confluence section 26*a*, and similarly, the first and fourth exhaust pipes 21, 24 communicating with the outer cylinders with exhaust strokes not successive communicate with each other at the outer side confluence section 26*b*. Therefore, interference of exhausts can be avoided and the outer and inner confluence sections 26*a*, 26*b* gather at the cut 32*f* of the partition body 32.

A silencer chamber cover 40 is abutted against the bent inner side (reverse side) of the exhaust manifold 20 and welded thereto to form a silencer chamber 41.

Figure 4:
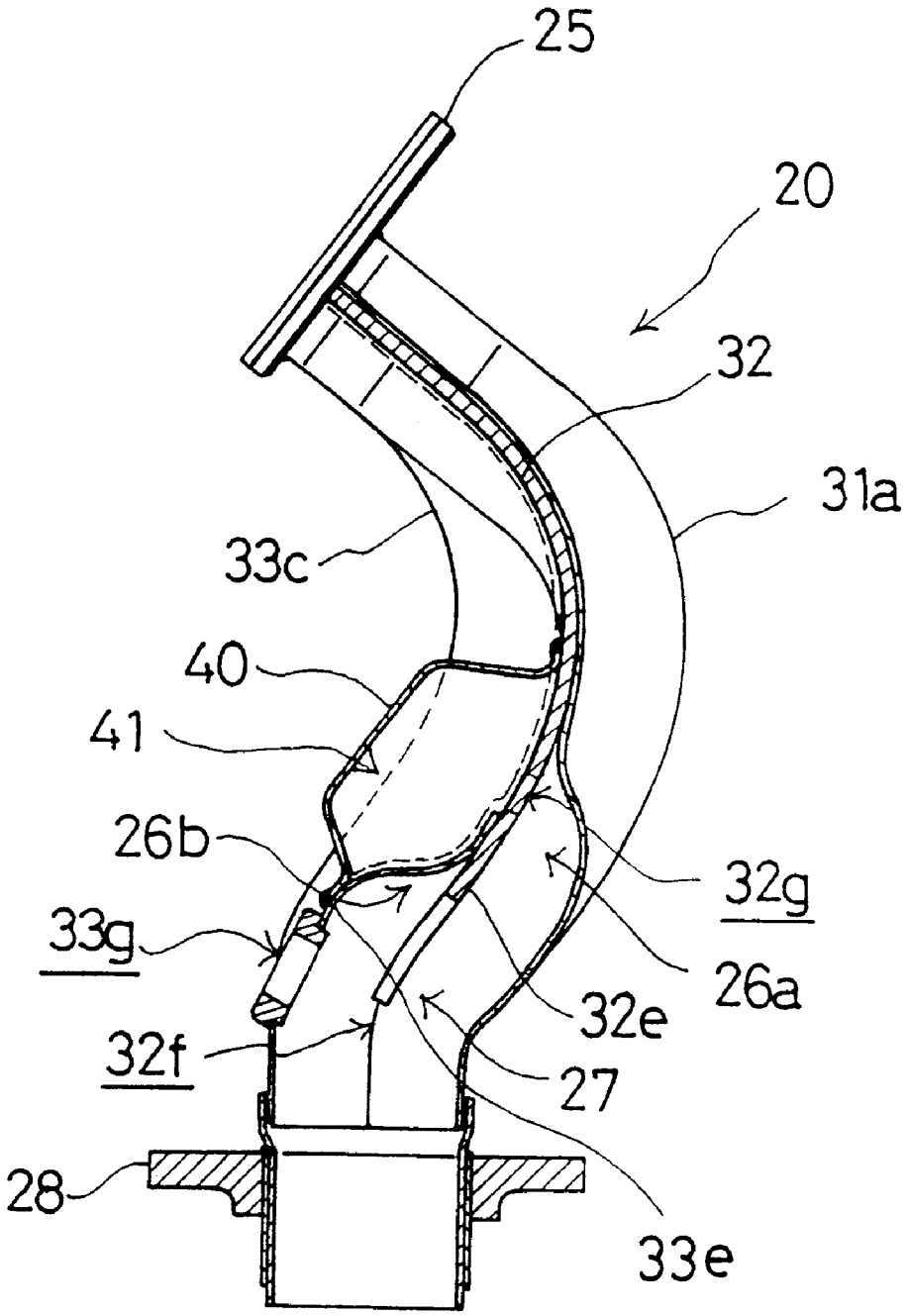
FIG. 4 is a section along the line IV—IV of FIG. 2 and FIG. 3.

The silencer chamber cover 40 is shaped like a box as shown in FIG. 4 and has an opening marginal edge 40*a* shaped so as to lie along reverse side surfaces of the confluence partition section 32*e* of the partition body 32 and the reverse side confluence half wall 33*e* of the reverse side confluence half wall 33*e*. The opening marginal edge 40*a* is contacted with the reverse side surfaces airtightly so that the silencer chamber 41 is formed by confluence partition section 32*e*, the reverse side confluence half wall 33*e* and the silence chamber cover 40.

The silencer chamber cover 40 covers the communication holes 32*g*, 32*h* of the confluence partition section 32*e* so that the interior of the silencer chamber 41 communicates with the inner side confluence section 26*a* through the communication holes 32*g*, 32*h*, and the inner side confluence section 26*a* communicates with the gathering section 27 essentially.

The silencer chamber 41 is filled with a ceramic wool which is a fibrous sound absorbing material. To an attachment hole 33*g* of the reverse half body 33 is fitted the oxygen sensor from the reverse side.

The exhaust manifold 20 assembled in such a way is fixed to the internal combustion engine 10 by means of the head flange 25 welded to the upper stream ends of the first, second, third, fourth exhaust pipes 21, 22, 23, 24.

Since the internal combustion engine 10 is inclined rearward and the exhaust manifold 20 extending rearward from the cylinder head 12 of the engine is bent downward, the exhaust manifold 20 is arranged compactly. Though a surplus space is formed between the bent portion of the exhaust manifold 20 and the internal combustion engine, the silencer chamber 41 is arranged in this surplus space so that the space is utilized effectively.

The exhaust manifold 20 constituted by the obverse half body 31, the partition body 32 and the reverse half body 33 made of plate metals and laid face to face with each other is simple in construction and lighter in weight compared with an exhaust manifold made of cast iron so that an improvement of fuel consumption can be expected.

The second, third exhaust pipes 22, 23 are formed by the obverse half body 31 and the partition body 32, and the first, fourth exhaust pipes 21, 24 are formed by the reverse half body 33 and the partition body 32, namely, the all exhaust pipes are formed by each one layer of obverse and reverse side half walls and have no portion where two half walls overlap on another to increase the weight.

The partition body 32 is made thicker than the obverse half body 31 and the reverse half body 33, therefore, the exhaust manifold can be lightened while maintaining high strength and rigidity.

Since the silencer chamber 41 is provided at the confluence section 26 and the gathering section 27 where temperature of the exhaust is highest, and attached to the partition body 32 which is thicker than the obverse and reverse half bodies 31, 33 and has high rigidity, combining rigidity of the plate metal members can be ensured without using another exclusive member, and vibration-resistance and durability of the exhaust manifold can be improved.

Since the communication holes 32*g*, 32*h* communicating with the silencer chamber 41 is formed in the partition body 32 which is relatively thick, lengths of the communication holes 32*g*, 32*h* necessary for obtaining the resonance effect can be ensured easily.

By making only the partition body 32 thicker, average thickness of the entire exhaust manifold 20 including the obverse half body 31 and the reverse half body 33 can be made thin while maintaining necessary strength and rigidity. Since the exhaust manifold 20 is arranged in rear of the internal combustion engine 10 inclined rearward and length of the exhaust passage to the catalyst converter 30 is short, even immediately after starting of the engine, the exhaust of high temperature reaches the catalyst converter 30 to activate the exhaust cleaning catalyst early and improve an initial performance thereof.

The silencer chamber 41 is capable of reducing exhaust sound, especially high frequency sound. Sound emitted from the silencer chamber 41 is intercepted by the exhaust manifold 20, the internal combustion engine inclined rearward and the dashboard 5 to keep the interior of the car quiet.

What is claimed is:

1. An exhaust manifold of a multi-cylinder internal combustion engine having two groups of cylinders selected so that exhaust strokes are not successive, including two exhaust pipe sections containing exhaust pipes communicating with said cylinders of each of said groups respectively, confluence sections where said exhaust pipes in each of said exhaust pipe sections join respectively, and a gathering section where said confluence sections join, wherein said exhaust manifold is constructed by an obverse half body, a partition body and a reverse half body made of plate metals and laid face to face with each other, said exhaust pipe sections and said confluence sections are formed by said partition body and one of said obverse and reverse half bodies, and said gathering section is formed by said obverse half body and said reverse half body.

2. An exhaust manifold of a multi-cylinder internal combustion engine having two groups of inner cylinders and outer cylinders selected so that exhaust strokes are not successive, including an inner side exhaust pipe section containing exhaust pipes communicating with said inner cylinders respectively, an outer side exhaust pipe section containing exhaust pipes communicating with said outer cylinders respectively, an inner side confluence section where said exhaust pipes in said inner side exhaust pipe section join, an outer side confluence section where said exhaust pipes in said outer side exhaust pipe section join, and a gathering section where said inner side confluence section and said outer side confluence section join, wherein said exhaust manifold is constructed by an obverse half body, a partition body and a reverse half body made of plate metals and laid face to face with each other, said inner side exhaust pipe section and said inner side confluence section are formed by said obverse half body and said partition body, said outer side exhaust pipe section and said outer side confluence section are formed by said reverse half body and said partition body, and said gathering section is formed by said obverse half body and said reverse half body.

3. An exhaust manifold as claimed in claim 1 or 2, wherein said partition body is thicker than any of said obverse half body and said reverse half body.

4. An exhaust manifold as claimed in claim 1 or 2, wherein a silencer is arranged on reverse side surfaces of said partition body and said reverse half body and a communication hole communicating with said silencer is formed in said partition body at said confluence section on side of said obverse half body.

* * * * *